US006588184B2

(12) United States Patent
Bussey, Jr. et al.

(10) Patent No.: US 6,588,184 B2
(45) Date of Patent: Jul. 8, 2003

(54) BAG FORMING AND FILLING MACHINE

(76) Inventors: Harry Bussey, Jr., 960 Cape Marco Dr. Unit 1803, Marco Island, FL (US) 33937; Buddy Harry Bussey, III, 4 Windy Hill, Atlantic Highlands, NJ (US) 07716

( * ) Notice: Subject to any disclaimer, the term of this patent is extended or adjusted under 35 U.S.C. 154(b) by 0 days.

(21) Appl. No.: 09/998,271

(22) Filed: Nov. 29, 2001

(65) Prior Publication Data

US 2003/0097827 A1 May 29, 2003

(51) Int. Cl.[7] ..... B65B 9/20
(52) U.S. Cl. ..... 53/551; 53/552
(58) Field of Search ..... 53/551, 552, 389.2, 53/451

(56) References Cited

U.S. PATENT DOCUMENTS 3,492,775 A * 2/1970 Rhine et al. ..... 53/451
4,129,976 A * 12/1978 Grundler et al. ..... 53/552
4,587,795 A * 5/1986 Yamashita ..... 53/551
4,589,247 A * 5/1986 Tsuruta et al. ..... 53/550
4,697,403 A * 10/1987 Simpson et al. ..... 53/551
4,829,745 A * 5/1989 Behr et al. ..... 53/551
5,255,496 A * 10/1993 Gregoire ..... 53/551
5,548,947 A * 8/1996 Fincham et al. ..... 53/551
5,551,206 A * 9/1996 Fukuda ..... 53/551

* cited by examiner

*Primary Examiner*—John Sipos
(74) *Attorney, Agent, or Firm*—Francis C. Hand; Carella, Byrne, Bain et al

(57) ABSTRACT

The bag filling and forming machine employs a chute for conveying a flow of loose fill material, a form for enveloping a sheet of plastic film about the chute, a heat-seal roller for sealing the overlapped edges of the film to form a tube and heat-seal bars for sealing the tube at spaced apart positions to form the top and bottom of bags. A pair of conveyors are provided for continuously moving the formed tube relative to the chute and fingers are provided for spreading the tube into a flattened configuration for heat-sealing purposes. A hot wire or cutting knife is provided for cutting off a filled bag after heat-sealing.

18 Claims, 3 Drawing Sheets

BAG FORMING AND FILLING MACHINE

This invention relates to a bag forming and filling machine. More particularly, this invention relates to a bag forming and filling machine for loose fill material.

Heretofore, various types of machines have been employed for filling loose fill material into bags suitable for shipping purposes. For example, U.S. Pat. No. 6,035,606 describes a filling machine in which a bag is suspended within an opening of a conveyor. As the conveyor moves the bag past various stations, air is blown into the bag to open the bag, a flow of loose fill material is delivered into the bag and then the bag is closed at the upper end while still suspended from the conveyor. Filling and bagging machines of this type require manual placement of a bag onto the conveyor. However, this can be time-consuming.

Accordingly, it is an object of the invention to provide an automatic bagging machine for forming and filling bags with loose fill material, It is another object of the invention to reduce the time required to fill and seal a series of bags with loose fill material.

It is another object of the invention to eliminate the need for a pre-made bag and to thereby reduce the cost of filled bags of loose fill material.

Briefly, the invention provides a bag forming and filling machine which is completely automatic.

The machine includes a chute for conveying a flow of loose fill material, for example, that is delivered from a hopper. Suitable means are also provided within the hopper or chute in order to deliver the flow of loose fill material on an intermittent basis such that each charge of material is predetermined for the size of the bag to be filled.

The filling machine also includes a forming means for enveloping a sheet of plastic film about the chute with overlapping longitudinally disposed edges. The forming means cooperates with any suitable supply means for supplying the sheet of plastic film, for example, from a roll.

The machine also includes a heat-sealing means for heat-sealing the overlapping edges of the plastic sheet together to form a tube about the chute. This heat-sealing means may be in the form of a heated roller that is mounted on a stationary axis to heat-seal the overlapping edges of the plastic sheet together as the sheet passes by the roller.

The machine also has a conveying means for moving the formed tube longitudinally relative to and away from the chute to continuously pull the sheet into the forming means to form a continuous tube and to allow a flow of loose fill material from the chute to fill the tube. This conveying means may employ a pair of endless belt conveyors, each of which is disposed to engage the formed tube between the conveyor and the chute.

The machine also has a heat seal bar assembly downstream of the chute relative to a flow of loose fill material for forming a transverse heat seal across the tube as well as a means for severing the tube at the transverse heat seal to form a sealed bag of loose fill material on one side and a bottom for a subsequently formed bag of loose fill material on the opposite side. For example, a hot wire or knife may be used for severing the tube.

The machine also has a means for spreading the tube into a flattened shape upstream of the heat seal bar assembly and for accumulation of the tube thereon. This means includes a pair of movable fingers or flaps that extend from the chute and means for selectively moving each of the fingers relative to the chute between a retracted position within the plane of the tube and an extended position for spreading the tube into a flattened shape. This latter means may be internally mounted to move the fingers or flaps from within the plane of the chute or externally mounted to move the fingers or flaps from outside the chute.

During operation, the conveying means moves the formed tube continuously while the heat-seal bar assembly operates on an intermittent basis. However, the movement of the tube is impeded by the extended fingers or flaps so that the tube does not move beyond the fingers or flaps but instead is spread into a flattened shape and accumulated or bunched up on the fingers or flaps. Thus, while the heat-seal bar assembly is forming a transverse seal in a part of the tube that is stationary, the tube upstream of the heat-seal bar assembly buckles and gathers itself on the extended fingers.

After a seal has been formed and the heat-seal bar assembly moved away from the tube, the fingers are retracted and a charge of loose fill material is delivered via the chute into the tube. The weight of this material then causes the bag to slide off the retracted fingers or flaps and extend under gravity away from the chute and into a smooth round shape.

After a full charge of material has been delivered into the tube, the fingers or flaps are again extended to flatten the top of the bag and the heat-seal bar assembly is again activated to seal the top of the bag. The sealed bag is also severed from the remainder of the tube and falls under gravity, for example, onto a conveyor located below the heat-seal bar assembly. The cycle of operation is then repeated.

In one embodiment, the chute is vertically disposed. In this case, a sealed bag may be deposited under gravity directly onto a conveyor located below the chute.

In another embodiment, the chute is angularly disposed to a vertical plane. In this embodiment, a ramp is located below the heat-sealing means for guiding the sealed bag of loose fill material thereon onto a conveyor located below the ramp.

These and other objects and advantages of the invention will become more apparent from the following detailed description taken in conjunction with the accompanying drawings, wherein.

Figure 1:
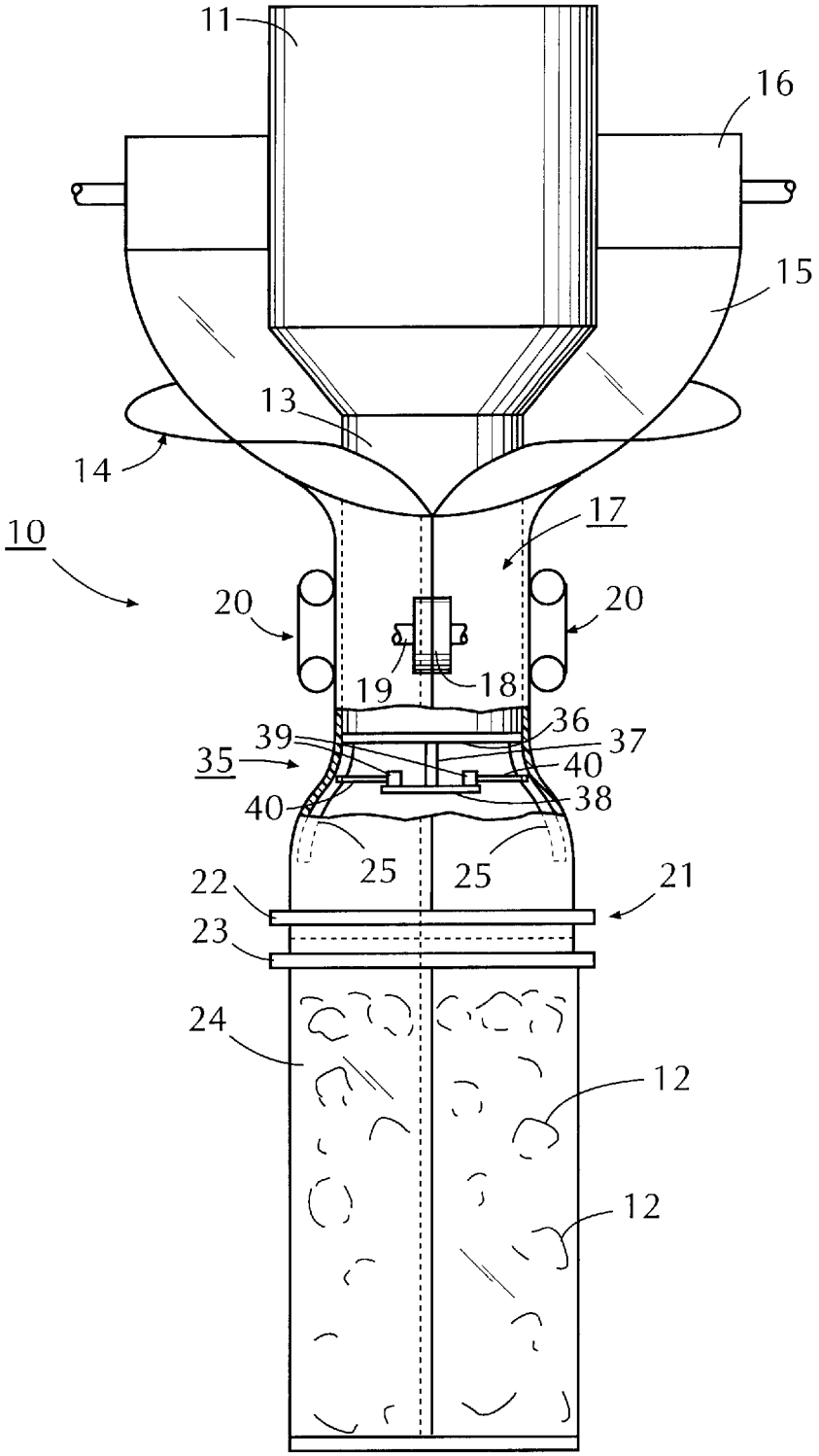
FIG. 1 illustrates a front view of a bag forming and filling machine constructed in accordance with the invention.

Referring to FIG. 1, the bag forming and filling machine 10 includes a chute 11 for conveying a flow of loose fill material 12, e.g. discrete foamed polymeric elements that may be of various shapes. As illustrated, the chute 11 is vertically disposed to deliver the loose fill material 12 under gravity and has a necked-down portion terminating in a cylindrical spout 13 that is removably mounted so that spouts of different diameters may be mounted in place to accommodate the size of the bag to be formed and filled. Conventional means are provided in the chute 11 to discharge a predetermined amount of material from the chute 11 on an intermittent basis and need not be further described.

The machine also has a forming means 14 of conventional structure for enveloping a sheet of plastic film 15 about the spout 13 of the chute 11 in a cylindrical manner with overlapping longitudinally disposed edges. As indicated, the sheet of plastic film 15 may be supplied from a roll 16 disposed adjacent to the chute 11 or from another remote location. For example, the forming means 14 may be a bag forming unit sold by Formers by Ernie, Inc. of Houston, Tex.

The machine 10 also includes a heat-sealing means 17 for heat-sealing the overlapping edges of the sheet of plastic film 15 together to form a tube about the spout 13 of the chute 11. The heat-sealing means 17 is in the form of a heated roller 18 which rotates on an axle 19 to press the overlapping edges together against the spout 13. In order to protect the spout 13 against heat damage, a slick heat insulating strip, for example, a strip of Teflon® tape (not shown) is disposed on the spout 13 in facing relation to the roller 18.

Conveying means have also provided for moving the formed tube longitudinally relative to the chute 11 to continuously pull the sheet 15 into the forming means 14 and to allow the flow of loose fill material 12 from the chute 11 to fill the tube. As illustrated, the conveying means includes a pair of endless belt conveyors 20, each of which is disposed to engage the formed tube between the spout 13 and the conveyor 20. In this respect, the forming means 14 shapes the sheet 15 into a tube that has an inside diameter slightly larger than the outside diameter of the spout 13. This is to avoid sliding of the tube along the spout 13 over the entire periphery of the tube. The heat-sealing roller 18 thus only needs to press a small peripheral portion of the tube against the spout 13 in order to heat-seal the overlapping edges of the sheet 15 together. Likewise, the endless belt conveyors 20 need only press a small portion of the periphery of the tube against spout 13 in order to drive the tube downwardly, as viewed.

A heat-seal bar assembly 21 is disposed downstream of the spout 13 of the chute 11 to effect a transverse seal across the tube. In the illustrated embodiment, the heat-seal bar assembly includes two pairs of seal bars 22,23 (only one seal bar of each pair is shown) that are vertically spaced apart for forming a pair of parallel spaced-apart transverse seals across the tube. Such a heat-seal bar assembly 21 is of generally conventional construction and need not be further described. Each pair of seal bars 22,23 is mounted so that the two seal bars may be reciprocated relative to each other to move between a retracted position that allows the filled tube to pass by and an extended position that brings the seal bars into contact with the tube to effect a transverse seal.

A means (not shown) is also provided for perforating or severing the tube between the two pair of seal bars 22,23, that is, between the spaced-apart seals, in order to form a sealed bag 24 of loose fill material 12 on the downside and form a sealed bottom for a subsequently formed bag on the top side. For example, a perforating element or a hot wire or knife (not shown) may be mounted on one of the upper seal bars 22 in a conventional manner for perforating or severing the tube between the spaced-apart seals.

The machine also includes means for spreading the tube into a flattened shape upstream of the heat-seal bar assembly 21 and for accumulation of the tube thereon. This means includes a pair of movable fingers or flaps 25 that extend from the spout 13 and means 35 for selectively moving each of the fingers 25 relative to the spout 13 between a retracted position within the plane of the spout 13 and the formed tube (not shown) and an extended position, as shown, for spreading the tube into a flattened shape. In the illustrated embodiment, each finger 25 is pivotally mounted and suspended from the bottom of the spout 13 and the means for moving the fingers 25 includes a pair of piston and cylinder arrangements mounted within the plane of the spout 13. As indicated, a strut 36, e.g. a ½ inch rod, is placed across the bottom end of the spout 13 and carries an inverted T-shaped unit having a vertical piece 37, e.g. a ½ inch rod and a cross-bar 38 at the lower end. Each leg of the cross-bar 38 carries a piston and cylinder unit 39 that has a reciprocating piston 40 that is pivotally connected to a finger 25 in order to move the finger 25 between a retracted position within the plane of the spout 13 and an extended position as the piston is reciprocated. Each piston and cylinder unit may be actuated pneumatically or electrically via lines (not shown) that pass within the spout 13 to a suitable source of power. The piston and cylinder arrangements and the supporting structure are of limited size and offer a minimal resistance to the flow of material through the spout 13.

Alternatively, each finger 25 may be mounted in a spring biased manner to move from the retracted position to the extended position against the force of the tube. This eliminates the need for a piston and cylinder arrangement within the flow path of the loose fill material.

To begin operation, the sheet of plastic film 15 is manually delivered into the forming means 14 and pulled under the conveyors 20. Next, the overlapping edges are heat-sealed by the roller 18 to form a tube and the tube pulled manually downwardly passed the heat-seal bars 22,23. Initially, the fingers 25 are in the extended positions so that the tube which is being formed begins to spread into a flattened shape while also beginning to accumulate, or bunch up, on the fingers 25. At this time, the lower end of the tube may then be pulled down manually from the fingers 25 beyond the heat-seal bars 22,23. Initially, the heat-seal bars 22,23 are disposed in a retracted position to be spaced from the tube.

Once the seal bars 22,23 have been cycled to move from the retracted positions spaced from the tube to the extended positions to seal the tube transversely along two spaced-apart seal lines, the operation of the machine continues automatically. That is to say, after the tube has been initially sealed, the heat-seal bars 22,23 are retracted to the retracted positions and the conveyors 20 caused to automatically pull the sheet 15 into the forming means 14 and to push the tube along the spigot 13.

As the endless conveyors 20 continue to move the tube downwardly, the tube continues to accumulate on the fingers 25. After a programmed time has passed, a charge of loose fill material is delivered via the spout 13 into the tube. In this respect, the chute 11 is provided with a conventional means for dispensing predetermined charges of loose fill material and need not be further described. In addition, the fingers 25 are retracted so that the tube takes on a smooth round (cylindrical) shape.

Upon delivery of the loose fill material into the tube, which has now been sealed at the bottom, the weight of the loose fill material pulls the accumulated portions of the tube from the fingers 25. Thereafter, the fingers 25 are again extended to flatten the tube and the seal bars 22,23 are again moved to the extended positions to form a transverse seal in the flattened tube to seal the top of the bag 24, as indicated in FIG. 1. At the same time, the sealed bag 24 is severed from the remainder of the tube and falls under gravity, for example, onto a conveyor (not shown), located below the heat-seal bar assembly 21. The cycle, of operation is then repeated. In the case where a perforation is made between the heat sealed areas, the weight of the bag would be sufficient to cause the tube to tear along the perforation so that the filled bag may drop away under gravity along the perforation.

Figure 2:
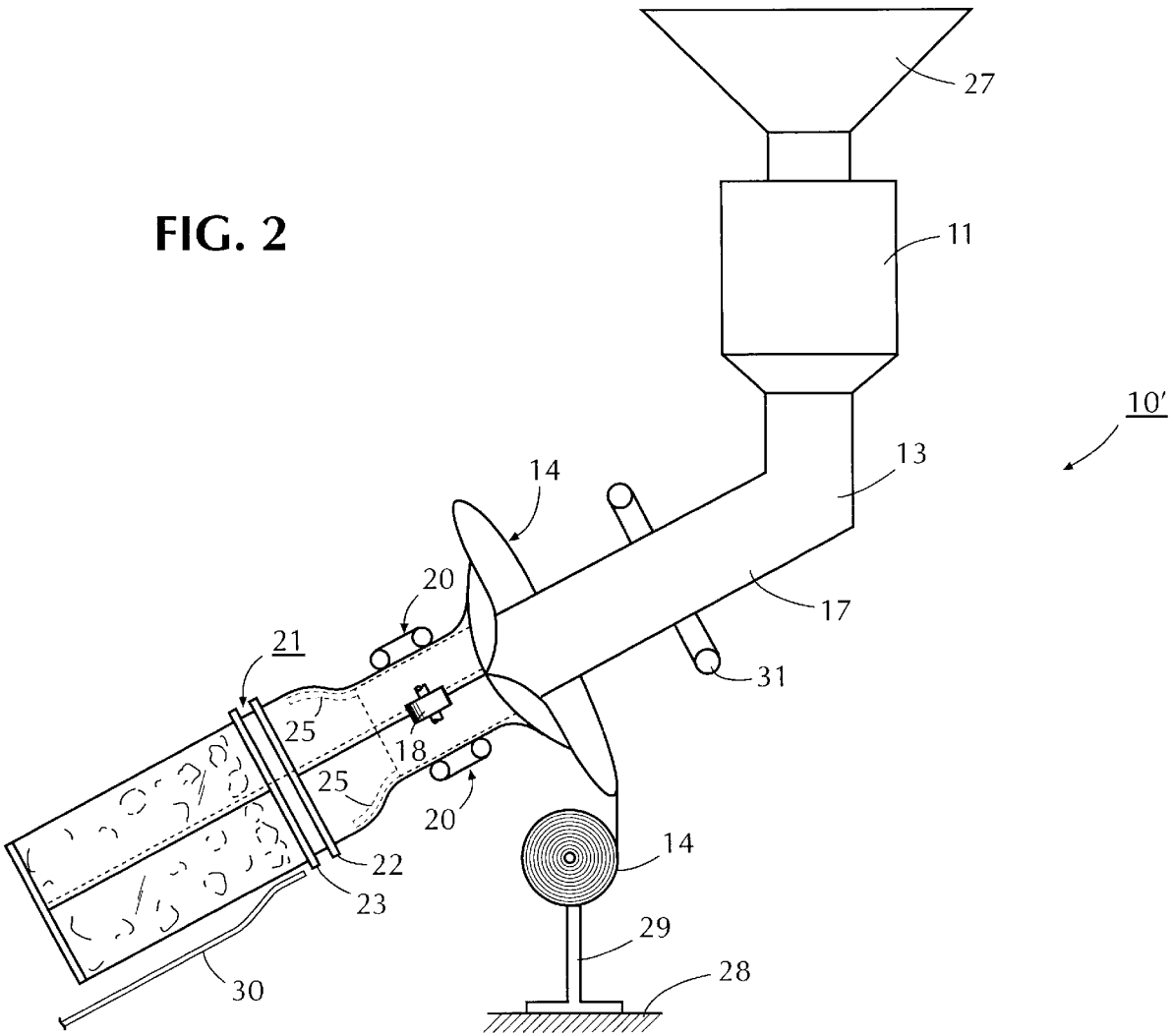
FIG. 2 illustrates an embodiment of a bag forming and filling machine employing an angularly disposed chute in accordance with the invention.

Referring to FIG. 2, wherein like reference characters indicate like parts as above, the machine 10' may be constructed for environments having a limited ceiling height. In this embodiment, the chute 11 is angularly disposed to a vertical plane. As indicated, the chute 11 receives a flow of loose fill elements from a hopper 27 located above the chute 11. In addition, the roll 14 of plastic film may be mounted on a floor 28 of the room via a suitable support 29 under the forming means 14.

In addition, a ramp 30 is located below the heat-seal bars 22,23 for guiding the sealed bag 26 of loose fill material thereon onto a conveyor (not shown) located below the ramp 30.

In this embodiment, air may be blown from a blower 31 into the formed tube along with the loose fill material to ensure a flow of the material into the angularly disposed tube.

Figure 3:
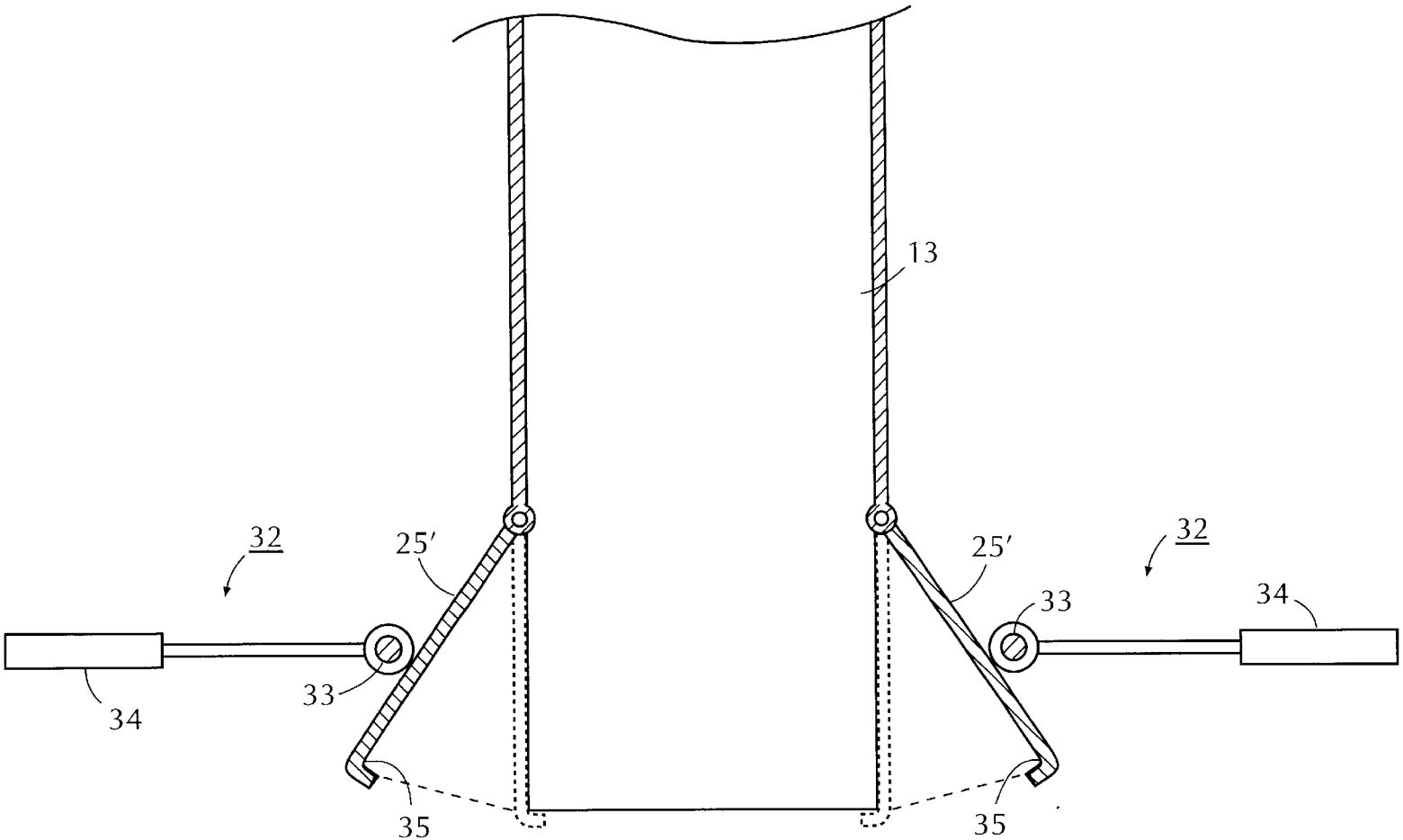
FIG. 3 illustrates a schematic view of an externally disposed means for moving the flaps of a chute to an extended position.

Referring to FIG. 3, wherein like reference characters indicate like parts as above, the spout 13 may be constructed to have a pair of fingers or flaps 25' pivotally mounted within the plane of the spout 13. In this embodiment, external means 32 are provided for moving the flaps 25' between a retracted position in the plane of the spout 13 at an extended position, as shown, outwardly of the spout 13. Each external means 32 includes a magnet 33, e.g. in the form of a rotatably mounted roller, that faces a respective flap 25' and a piston and cylinder assembly 34 articulated to the magnet 33 for moving the magnet 33 between an extended position in space-facing relation to the flap 25' with the flap 25' in the retracted position thereof in order to attract the flap 25' to the magnet 33 and a retracted position, as shown, spaced from the spout 13 in order to move the flap 25' to the extended position thereof. As illustrated, the magnet 33 is of cylindrical shape to accommodate the pivoting movement of a flap 25' upon engagement therewith.

As also illustrated, each flap 25' has an inwardly curved terminal end 35 to avoid tearing of the plastic sheet sliding thereover.

In order to move the flaps 25' outwardly of the spigot 13, the magnets 33 are brought into an extended position in slightly spaced relation to the flaps 25'. In this respect, the flaps 25' are magnetically attracted either by being made of magnetically attractive material or having a magnetic strip placed thereon. In any event, with the plastic tube sliding over the spout 13 and flaps 25', the magnets 33 attract the flaps and then move the flaps 25' outwardly as the magnets 33 are retracted via the piston and cylinder assemblies 34 into the position shown in FIG. 2. During this time, the plastic tube continues to slide along the flaps 25' while the magnets also rotate to avoid damaging the plastic film.

Various modifications may be made in the machine, for example, nip rolls may be positioned at the bottom of the spigot 13 to engage the formed tube against the spigot 13 to facilitate movement of the tube. Further, in order to facilitate removal of the formed plastic tube from the spigot 13, a pair of rollers (not shown) may be located at each of the curved ends of the fingers 25 or flaps 25' to grip the tube in a nip. One roller of each pair is of an idler type that is mounted on a curved end of a finger 25 or flap 25' via a releaseable coupling (not shown) to be located inside the tube. The other roller is driven by a suitable means (not shown) and is located outside the tube. The rollers are driven in synchronism with the bag filling operation to automatically pull the tube from the spigot 13. Alternatively, the tube may be pulled off the spigot 13 by eliminating the idler roller of each pair of rollers and having the driven roller of each pair engage a curved end of the finger 25 or flap 25' to form a nip within which to grip and pull the bag 14 off the mandrel 10.

The roll 16 of plastic film may be of any suitable size e.g. of 600 feet, to form a large number of bags, e.g. 100 bags per roll 16 with each bag having a diameter of 24 inches and a capacity of 14 cubic feet.

The machine may also be adapted to form bags of different widths and different lengths. For example, the transverse heat seal assembly 21 may be raised or lower relative to the spigot 13 to form bags of shorter or greater length. Also, the spigot 13 may be made of greater or lesser diameter along with the fingers or flaps 25,25' to form a bag of greater or lesser width.

The invention thus provides a bag-forming and filling machine which may operate automatically on a continuous basis. Further, the invention provides a machine which is capable of forming a sheet of plastic film into a tube, of filling the tube with loose fill material and of sealing the tube at spaced-apart points to form a series of bags filled with loose fill material.

The machine is capable of continuous operation so long as there is a supply of plastic film to form the bags and a supply of loose fill material for filling the bags.

What is claimed is:

1. A bag forming and filling machine comprising a forming means for shaping a sheet of plastic film into a cylindrical shape with overlapping longitudinally disposed edges;

heat sealing means for heat sealing the overlapping edges of the sheet together to form a tube;

conveying means for moving the formed tube longitudinally from said forming means to allow a flow of loose fill material to fill the tube;

a heat seal bar assembly downstream of said forming means relative to a flow of loose fill material for forming a transverse heat seal across the tube to retain loose fill material therein;

means for spreading the tube into a flattened shape upstream of said heat seal bar assembly and for accumulation of the tube thereon during transverse heat sealing thereof; and means for severing the tube at said transverse heat seal to form a sealed bag of loose fill material on one side thereof and to form a sealed bottom for a subsequently formed bag of loose fill material.

2. A bag forming and filling machine as set forth in claim 1 wherein said heat sealing means includes a roller for pressing the overlapping edges of the sheet against said chute to effect a heat sealing of the edges together.

3. A bag forming and filling machine as set forth in claim 1 wherein said means for spreading out the tube includes a pair of movable fingers and means for moving each of said fingers relative to said chute between a retracted position and an extended position for spreading the tube into a flattened shape.

4. A bag forming and filling machine as set forth in claim 3 wherein each of said fingers is magnetically attractive and said means for moving each of said fingers includes a magnet facing a respective finger and a piston and cylinder assembly articulated to said magnet for moving said magnet between an extended position in spaced facing relation to said finger with said finger in said retracted position thereof to attract said finger to said magnet and a retracted position to move said finger to said extended position thereof.

5. A bag forming and filling machine as set forth in claim 3 wherein said means for moving each of said fingers includes a piston and cylinder assembly within a plane of said fingers and articulated to said fingers to move said fingers between said positions thereof.

6. A bag forming and filling machine comprising a chute for conveying a flow of loose-fill material therethrough;

a forming means for enveloping a sheet of plastic film about said chute with overlapping longitudinally disposed edges;

heat sealing means for heat sealing the overlapping edges of the sheet together to form a tube about said chute;

conveying means about said chute for continuously moving the formed tube longitudinally relative to said chute to allow a flow of loose fill material from said chute to fill the tube;

means on an end of said chute for accumulation of the formed tube thereon and for spreading out the tube into a fattened shape therebelow;

a heat seal bar assembly downstream of said chute relative to a flow of loose fill material for forming a transverse heat seal across the flattened tube: and means for severing the tube at said transverse heat seal to form a sealed bag of loose fill material on one side thereof and to form a sealed bottom to receive a charge of loose fill material thereon whereby the weight of the charge pulls the accumulated portions of the tube from said means on the end of said chute.

7. A bag forming and filling machine as set forth in claim 6 wherein said means on said chute for accumulation of the tube thereon includes a pair of movable fingers extending from said chute and means for moving each of said fingers relative to said chute between a retracted position and an extended position for accumulating the tube thereon.

8. A bag forming and filling machine as set forth in claim 7 wherein each of said fingers is magnetically attractive and said means for selectively moving each of said fingers includes a magnet facing a respective finger and a piston and cylinder assembly articulated to said magnet for moving said magnet between an extended position in spaced facing relation to said finger with said finger in said retracted position thereof to attract said finger to said magnet and a retracted position spaced from said chute to move said finger to said extended position thereof outwardly of said chute.

9. A bag forming and filling machine as set forth in claim 7 wherein said means for moving each of said fingers includes a piston and cylinder assembly within a plane of said chute and articulated to said fingers to move said fingers between said positions thereof.

10. A bag forming and filling machine as set forth in claim 6 wherein said chute is vertically disposed.

11. A bag forming and filling machine as set forth in claim 6 wherein said chute is angularly disposed to a vertical plane.

12. A bag forming and filling machine as set forth in claim 6 wherein said heat sealing means includes a roller for pressing the overlapping edges of the sheet against said chute to effect a heat sealing of the edges together and a heat insulating strip on said chute and opposite said roller.

13. A bag forming and filling machine as set forth in claim 6 wherein said conveying means includes a pair of endless belt conveyors, each said conveyor being disposed to engage the formed tube between said conveyor and said chute.

14. A bag forming and filling machine as set forth in claim 6 wherein said heat sealing means operates on an intermittent basis.

15. A bag forming and filling machine as set forth in claim 6 wherein said heat seal bar assembly includes at least a pair of seal bars for forming a pair of parallel spaced apart transverse seals across the tube and said means for severing severs the tube between said spaced apart transverse seals.

16. A bag forming and filling machine as set forth in claim 6 which further comprises a conveyor below said heat sealing means for receiving a sealed bag of loose fill material.

17. A bag forming and filling machine as set forth in claim 6 wherein said chute is angularly disposed to a vertical plane and which further comprises a ramp below said heat sealing means for guiding a sealed bag of loose fill material thereon.

18. A bag forming and filling machine as set forth in claim 17 which further comprises a conveyor below said ramp for receiving a sealed bag of loose fill material.

* * * * *